US005223161A

United States Patent [19]

Waynick

[11] Patent Number: 5,223,161

[45] Date of Patent: Jun. 29, 1993

[54] EXTREME PRESSURE AND WEAR RESISTANT GREASE WITH SYNERGISTIC SULFATE AND CARBOXYLATE ADDITIVE SYSTEM

[75] Inventor: John A. Waynick, Bolingbrook, Ill.

[73] Assignee: Amoco Corporation, Chicago, Ill.

[21] Appl. No.: 590,483

[22] Filed: Sep. 28, 1990

Related U.S. Application Data

[63] Continuation-in-part of Ser. No. 371,913, Jun. 2, 1989, Pat. No. 4,986,923.

[51] Int. Cl.[5] ..... C10M 125/22

[52] U.S. Cl. ..... 252/25; 252/40.7; 252/42.1; 252/18

[58] Field of Search ..... 252/18, 25, 40.7, 42.1

[56] References Cited

U.S. PATENT DOCUMENTS

| | | | |
|---|---|---|---|
| 3,826,744 | 7/1974 | Holinski et al. | 252/25 |
| 3,846,315 | 11/1974 | Stanton et al. | 252/25 |
| 4,168,241 | 9/1979 | Kozima et al. | 252/25 |
| 4,759,859 | 7/1988 | Waynick | 252/25 |
| 4,929,371 | 5/1990 | Waynick | 252/25 |

*Primary Examiner*—Jacqueline V. Howard

*Attorney, Agent, or Firm*—Thomas T. Tolpin; James R. Henes; Frank J. Sroka

[57] ABSTRACT

A high performance lubricating grease effectively lubricates and greases front-wheel drive joints. The lubricating grease has excellent extreme pressure properties and antiwear qualities and is economical, effective, and safe. In one preferred form, the lubricating grease comprises a base oil, a polyurea thickener, an additive package comprising calcium sulfate and calcium acetate.

20 Claims, No Drawings

EXTREME PRESSURE AND WEAR RESISTANT GREASE WITH SYNERGISTIC SULFATE AND CARBOXYLATE ADDITIVE SYSTEM

CROSS REFERENCES TO RELATED APPLICATION

This patent application is a continuation-in-part of Ser. No. 07/371,913, filed Jun. 2, 1989, entitled Front Wheel Drive Grease with Synergistic Sulfate and Carbonate Additive System, now U.S. Pat. No. 4,986,923.

BACKGROUND OF THE INVENTION

This invention pertains to lubricants and, more particularly, to a lubricating grease which is particularly useful for drive joints of front-wheel drive vehicles.

In front-wheel drive automobiles, vans, and trucks, the front wheels are driven by the engine via a front axle assembly and a number of front-wheel drive joints. These front-wheel drive joints facilitate movement of the front axle assembly while maintaining constant rotational velocity between the front wheels. The front-wheel drive joint is often referred to as a constant velocity (CV) joint. The outer CV joint usually has a boot comprising an elastomer, such as polyester or neoprene, and the inner joint usually has a boot comprising a higher temperature-resistant elastomer, such as silicon-based elastomers.

Front-wheel drive joints experience extreme pressures, torques, and loads during use. Operating temperatures can vary from −40° F. during winter to over 300° F. during summer.

Front-wheel drive greases are required to provide wear resistance. When a front-wheel drive vehicle is driven, sliding, rotational, and oscillatory (fretting) motions simultaneously occur within the front wheel drive joint, along with large loads and torques. A grease which minimizes wear from one of these motions or conditions will not necessarily protect against the others.

With the newer designs of many automobiles, trucks, vans, and other mobile equipment, the extreme pressure and wear resistance properties of the front-wheel drive grease have steadily increased. Previous additive technologies which give levels of performance typified by prior art greases may no longer be satisfactory for truly outstanding performance. Higher levels of performance are desired.

Front-wheel drive greases are also required to be chemically compatible with the elastomers and seals in front-wheel drive joints. Such greases should not chemically corrode, deform, or degrade the elastomers and seals which could cause swelling, hardening, loss of tensile strength, and ultimately rupture, oil leakage, and mechanical failure of the CV joints and seals.

Another requirement of front-wheel drive greases is that the grease and all its components be non-reactive, and non-corrosive to ferrous and non-ferrous metals even when prolonged contact occurs at high temperatures. The importance of this is readily apparent in applications such as front-wheel drive joint lubrication where temperatures in excess of 300° F. can occur and the grease must perform for the entire life of the joint. If the lubricant or any component therein becomes corrosive to the steel parts, such corrosion will result in accelerated wear and ultimate failure of the joint. Similarly, if any component of the grease reacts with water to form corrosive compounds, similar premature joint failure will result. This latter effect can be particularly troublesome since small amounts of moisture will usually be present in the joint due to the ambient humidity of the air.

Another requirement of front-wheel drive greases is that they should be toxicologically safe. During the assembly line filling of CV joints with front-wheel drive grease, workers can be exposed to the lubricant. Also, the front-wheel drive grease used by CV joint manufacturers is also often used in CV joint repair kits which are sold in various automotive parts retail stores. These kits are sold to members of the general public who wish to repair or replace a CV joint or CV joint boot on their car. The grease in such kits is generally stored in a plastic pouch. Persons using such kits will invariably come in contact with the grease during the act of opening the pouch and applying the grease to the CV joint. Therefore, front-wheel drive grease should contain no materials which are severe skin irritants. Moreover, front-wheel drive grease should contain no materials which are carcinogenic or mutagenic. Neither should front wheel drive greases contain materials which are members of the same chemical family of similar materials which have been shown to be carcinogenic or mutagenic.

Over the years, a variety of greases and processes have been suggested for use with front-wheel drive joints and/or other mechanisms. Typifying such greases and processes are those found in U.S. Pat. Nos. 2,964,475; 2,967,151; 3,259,573; 3,344,065; 3,843,528; 3,846,314; 3,920,571; 4,107,058; 4,305,831; 4,431,552; 4,440,658; 4,514,312; 4,759,859; 4,787,992; 4,830,767; 4,859,352; 4,879,054; 4,902,435; and Re. 31,611. These greases have met with varying degrees of success but most do not meet all the requirements described above.

In particular, U.S. Pat. No. 3,259,573 does not provide the higher level of performance required in todays more highly loaded CV joints and other similarly loaded parts.

U.S. Pat. Nos. 4,107,058, 4,305,831, and 4,431,552 do not provide compositions with non-corrosivity to elastomers, ferrous metals and non-ferrous metals at prolonged high temperatures due to their required inclusion of organo-sulfur materials.

U.S. Pat. No. Re 31,611 requires the use of materials which are very corrosive to ferrous and non-ferrous metals at high temperatures. Furthermore, this corrosive action dramatically accelerates the rusting of ferrous metals if even very low levels of moisture are present. Also, these materials are members of a family of compounds which have been found to exhibit carcinogenic characteristics, to be of limited solubility in mineral oil, or both.

It is, therefore, desirable to provide an improved extreme pressure and wear-resistant grease which overcomes most, if not all, of the above problems.

SUMMARY OF THE INVENTION

An improved lubricating grease is provided which is particularly useful for applications wherein extreme pressures and high wear conditions occur. The novel grease displayed unexpected surprisingly good results over prior art greases. The new grease provides superior wear protection from sliding, rotational, and oscillatory (fretting) motions in front-wheel drive joints. It is also chemically compatible with elastomers and seals in front-wheel drive joints and other industrial, automotive, and military applications. It further resists chemical corrosion, deformation, and degradation of the elastomers and extends the useful life of CV (constant velocity) drive joints. The novel grease performs well at high temperatures and over long periods of time. It exhibits excellent stability, superior fretting wear qualities, and outstanding oil separation properties even at high temperatures. It is also remarkably non-reactive, non-corrosive, and passive towards ferrous and even non-ferrous metals such as copper at prolonged high temperatures as high as 300° F. or even 350° F. This property is important in extending the useful life of CV-joints which can operate at such temperatures. Advantageously, the novel grease is economical to manufacture, toxicologically safe, and can be produced in large quantities.

To this end, the improved lubricating grease has: (a) a substantial proportion of a base oil, (b) a thickener, such as polyurea, triurea, or biurea, and (c) a sufficient amount of an additive package to impart extreme pressure properties to the grease.

In one form, the additive package comprises sulfates and aliphatic monocarboxylates. The sulfates are of a Group 2a alkaline earth metal, such as beryllium, magnesium, calcium, strontium, or barium, or a Group 1a alkali metal, such as lithium, sodium, or potassium. The aliphatic monocarboxylates are of a Group 2a alkaline earth metal or of a Group 1a alkali metal such as those described above. The aliphatic monocarboxylates have 1 to 5 carbon atoms per molecule, preferably 1 to 3 carbon atoms per molecule, and most preferably for best results 2 carbon atoms, i.e., acetate. Calcium sulfate and calcium acetate are preferred for best results and because they are economical, stable, nontoxic, and safe.

Anhydrous calcium sulfate is most preferred over the various hydrated forms of calcium sulfate since waters of hydration should be avoided in the final grease. However, if the grease is processed at such temperatures and pressures so as to remove any water of hydration from the grease, then hydrated forms of calcium sulfate can be used without substantial adverse effects in the final grease.

If desired, the calcium sulfate may be formed in situ in the grease by reaction of appropriate reagents. One example of such in situ formation of calcium sulfate is the reaction of calcium hydroxide and sulfuric acid. If this method of formation is used, then an excess of calcium hydroxide beyond the stoichiometric amount required to react with the sulfuric acid should be used. There are several reasons for this. First, excess or unreacted sulfuric acid should be avoided in the final grease. Such free, unreacted acid will seriously decrease, if not entirely eliminate, the desired elastomer compatibility of the final grease. Use of excess calcium hydroxide will insure that no unreacted sulfuric acid remains in the final grease. Another reason for using excess calcium hydroxide is that such excess unreacted calcium hydroxide further improves the wear resistance properties of the final grease.

When forming calcium sulfate in situ by reaction of calcium hydroxide and sulfuric acid, an excess of at least 2% calcium hydroxide over the stoichiometric required amount should be used. Preferably, at least 10% excess calcium hydroxide should be used. Most preferably for best results, at least 20% excess calcium hydroxide should be used when forming the calcium sulfate in situ.

While the above method of forming calcium sulfate in situ in the grease is preferred for best results, other methods may be used. One example is the reaction of calcium hydroxide and sulfur trioxide. Although this method may not be practical in many instances due to the toxic nature of sulfur trioxide, it none the less illustrates the fact that any method to produce the calcium sulfate is applicable in principle. The properties of the synergistic mixture of calcium sulfate and calcium acetate do not depend on the method by which each material was introduced to the grease. If another method to form in situ the calcium sulfate is used, the above remarks concerning excess calcium hydroxide will still generally apply as long as calcium hydroxide is used as a reagent in the formation reaction. Calcium sulfate provides many unexpected surprisingly good advantages over calcium bisulfate. For example, calcium sulfate is essentially water-insoluble and will not be extracted from the grease if contacted with water. Calcium sulfate is also very compatible with the elastomers and seals in front-wheel drive joints.

On the other hand, calcium bisulfate is water-soluble. When water comes into significant contact with calcium bisulfate it has a tendency to leach, run, extract, and wash out of the grease. This destroys much of the antiwear and extreme pressure qualities of the grease. Calcium bisulfate is also protonated and has acidic hydrogen present which can adversely react, crack, degrade, and corrode seals and elastomers.

The preferred aliphatic monocarboxylate is calcium acetate. The calcium acetate may be added as preformed calcium acetate, either as the anhydrous solid or in a hydrated solid form. If a hydrated solid is used, the grease should be heated to a temperature sufficient to remove by volatilization the water of hydration. This procedure will insure a water-free final grease, thereby enhancing many of the final grease properties such as elastomer compatibility and wear resistance.

Calcium acetate may also be formed in situ in the grease by reaction of appropriate chemical regents. The preferred route of such in situ formation is the reaction of calcium hydroxide and acetic acid. The acetic acid may be an aqueous solution of acetic acid or it may be the essentially pure glacial acetic acid. For economic reasons, the glacial acetic acid is generally preferred. When reacting calcium hydroxide and acetic acid, it is generally preferred to use excess calcium hydroxide relative to the stoichiometric amount required to react with all the acetic acid. The reasons for this follow logically from those given above concerning in situ formation of calcium sulfate.

First, excess or unreacted acetic acid should be avoided in the final grease. Such free, unreacted acid will seriously decrease, if not entirely eliminate, the desired elastomer compatibility of the final grease. Use of excess calcium hydroxide will insure that no unreacted acetic acid remains in the final grease. Another reason for using excess calcium hydroxide is that such excess unreacted calcium hydroxide further improves the wear resistance properties of the final grease. When forming the calcium acetate in situ by reaction of calcium hydroxide and acetic acid, an excess of at least 2% calcium hydroxide over the stoichiometric required amount should be used. Preferably, at least 10% excess calcium hydroxide should be used. Most preferably for best results, at least 20% excess calcium hydroxide should be used when forming the calcium acetate in situ.

Of course, other methods of forming calcium acetate in situ can be used. For instance, calcium hydroxide, acetic anhydride and water may be coreacted to form calcium acetate and water. Any method which forms the calcium acetate may be used as long as any undesirable by-products are removed from the final grease. The properties of the synergistic mixture of calcium sulfate and calcium acetate do not depend on the method by which each material was introduced to the grease.

If another method is used to form in situ the calcium acetate, the above remarks concerning excess calcium hydroxide will still generally apply as long as calcium hydroxide is used as a reagent in the formation reaction. The use of both sulfates and acetates in the additive package produced unexpected surprisingly good results over the use of equal amounts of either sulfates or acetates alone. For example, the use of both sulfates and acetates produced superior wear protection in comparison to a similar grease with an equal amount of acetates in the absence of sulfates, or a similar grease with an equal amount of sulfates in the absence of acetates.

Furthermore, the combination of the above sulfates and acetates achieved unexpected surprisingly good results in copper corrosion protection, even at 300° F. or 350° F., while also achieving compatibility with elastomers commonly used in front-wheel drive and other applications. This is in marked contrast to greases with other sulfur-containing materials such as insoluble arylene sulfide polymers which caused abrasion, corroded copper, degraded elastomers and seals, and significantly weakened their tensile strength and elastomeric qualities. Insoluble arylene sulfide polymers are also very expensive, making their use in lubricants prohibitively costly.

The non-corrosivity of the mixture of calcium sulfate and calcium acetate at very high temperatures is also in marked contrast to oil-soluble sulfur-containing materials. Oil-soluble sulfur-containing materials are, at high temperature, very corrosive to both ferrous and non-ferrous metals. This corrosivity makes such materials unacceptable in applications where the lubricant is to provide sealed-for-life lubrication to the part for years of service. The use of oil-soluble sulfur-containing compounds should also generally be avoided in the additive package of front-wheel drive greases because they are chemically very corrosive and detrimental to the elastomers generally used. Oil-soluble sulfur compounds often destroy, degrade, or otherwise damage constant velocity joint boot elastomers and seals by adversely affecting their tensile strength and elasticity. Of course, when used in other applications where elastomer compatibility at high temperatures and long life without relubricating are not concerns, the addition of oil-soluble and oil-insoluble sulfur-containing additives can be utilized in a manner well established and well known to those practiced in the grease-makers art.

In another form, the additive package comprises sulfates and acetates in which part, but not all, of the sulfate has been replaced with carbonates. It has been surprisingly and unexpectedly found that greases containing a mixture of sulfates and carbonates with acetates give higher performance than a similar grease which all the sulfates is replaced with an equivalent weight of carbonate. This fact proves that the combination of sulfate, carbonate, and acetate as an extreme pressure and wear resistance additive system is superior to the carbonate and acetate combination.

While the novel lubricating grease is particularly useful for front-wheel drive joints, it can also be advantageously used in universal joints and in bearings which are subjected to heavy shock loads, fretting, and oscillating motions.

Other applications for which the novel grease is useful include heavily loaded gears, bearings, spine joints, ball joints, fifth wheels, and the lubrication of railroad track/wheel flange interface such as is commonly done in the railroad industry, and sealed-for-life automotive wheel bearings.

A more detailed explanation of the invention is provided in the following description and appended claims.

DESCRIPTION OF THE PREFERRED EMBODIMENT

A high performance lubricating grease is provided to effectively lubricate and grease highly loaded applications such as found in industrial, automotive, military, or other applications. Such applications include heavily loaded gears, bearings, spine joints, universal joints, ball joints, fifth wheels, and the lubrication of railroad track/wheel flange interface such as is commonly done in the railroad industry. One particularly important application is the lubrication of constant velocity joints of front-wheel drive vehicles. The novel grease exhibits excellent extreme pressure (EP) properties and outstanding oil separation and antiwear qualities and is economical, nontoxic, and safe.

The novel grease is chemically compatible and substantially inert to the elastomers and seals of front-wheel drive joints and other lubricated mechanisms and provides a protective lubricating coating for said mechanisms. It will not significantly corrode, deform, or degrade silicon-based elastomers of the type used in the inner front-wheel drive joints, even at high temperatures experienced in prolonged desert driving. Nor will it significantly corrode, deform, or degrade front-wheel drive seals with minimal overbasing from calcium oxide or calcium hydroxide. It further will not corrode, deform, or degrade polyester and neoprene elastomers of the type used in the outer front-wheel drive joints and boots and substantially helps prevent the elastomers from cracking and becoming brittle during prolonged winter driving. It is also chemically inert to steel and copper even at the high temperatures which can be encountered in front-wheel drive joints and other highly stressed applications.

The grease is an excellent lubricant between contacting metals and/or elastomeric plastics. It provides superior protection against fretting wear caused by repetitive oscillating and jostling motions of short amplitude, such as experienced by new cars during shipment by truck or railroad. It also provides outstanding protection against dynamic wear caused by sliding, rotational and oscillating motions of large amplitudes, of the type experienced in rigorous prolonged highway and mountain driving. It further accommodates rapid torque and loading increases during acceleration and sudden heavy shock loads when a front-wheel drive vehicle rides over fields, gravel roads, potholes, and bumps.

The grease is also non-reactive, passive, and non-corrosive to ferrous and non-ferrous metals, even at prolonged temperatures of 300° F. or even 350° F.

The preferred lubricating grease comprises by weight: 45% to 85% base oil, 1% to 15% polyurea thickener, 0.2% to 40% extreme pressure wear-resistant additives. For best results, the front-wheel drive lubricating grease comprises by weight: at least 60% base oil, 3% to 10% polyurea thickener, 9% to 22% extreme pressure wear-resistant additives.

Inhibitors

The additive package may be complemented by the addition of small amounts of an antioxidant and a corrosion-inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alphanaphthyl amine, bis(alkylphenyl)amine, N,N-diphenyl-p-phenylenediamine, 2,2,4-trimethyldihydroquinoline oligomer, bis(4-isopropylaminophenyl)-ether, N-acyl-p-aminophenol, N-acylphenothiazines, N-hydrocarbylamides of ethylenediamine tetraacetic acid, and alkylphenol-formaldehyde-amine polycondensates.

Corrosion-inhibiting agents or anticorrodants prevent rusting of iron by water, suppress attack by acidic bodies, and form a protective film over metal surfaces to diminish corrosion of exposed metallic parts. A typical corrosion-inhibiting agent is an alkali metal nitrite, such as sodium nitrite. Other ferrous corrosion inhibitors include metal sulfonate salts, alkyl and aryl succinic acids and their salts, and alkyl and aryl succinate esters, amides, and other related derivatives. Borated esters, amines, ethers, and alcohols can also be used with varying success to limit ferrous corrosion. Likewise, substituted amides, imides, amidines, and imidazolines can be used to limit ferrous corrosion. Yet other ferrous corrosion inhibitors include certain salts of aromatic acids and polyaromatic acids, such as zinc naphthenate.

Metal deactivators can also be added to prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines.

Stabilizers, tackiness agents, dropping-point improvers, lubricating agents, color correctors, and/or odor control agents can also be added to the additive package.

Base Oil

The base oil can be naphthenic oil, paraffinic oil, aromatic oil, or a synthetic oil such as a polyalphaolefin (PAO), polyol ester, diester, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) alkylene oxide-type polymers, such as alkylene oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methyl-2-pentoxy) disilicone, poly(methyl)siloxane, and poly(methyl)-phenylsiloxane.

The preferred base oil comprises about 60% by weight of a refined solvent-extracted hydrogenated dewaxed base oil, preferably 850 SUS oil, and about 40% by weight of another refined solvent-extracted hydrogenated dewaxed base oil, preferably 350 SUS oil, for better results.

Thickener

Polyurea thickeners are preferred over other types of thickeners because they have high dropping points. The polyurea thickener does not melt or dissolve in the oil even at temperatures of 500° F. Polyurea thickeners are also advantageous because they have inherent antioxidant characteristics, work well with other antioxidants, and are compatible with all the elastomers and seals of front-wheel drive joints.

The polyurea comprising the thickener can be prepared in a pot, kettle, bin, or other vessel by reacting diisocyanate, or a polymerized diisocyanate, and water. Other amines can also be used.

Polyurea thickener was prepared in a pot by adding: (a) about 30% by weight of a solvent extracted neutral base oil containing less than 0.1% by weight sulfur with a viscosity of 600 SUS at 100° F. and (b) about 7.45% by weight of primary oleyl amine. The primary amine base oil was then mixed for 30–60 minutes at a maximum temperature of 120° F. with about 5.4% by weight of an isocyanate, such as 143 L manufactured by Dow Chemical Company. About 3% by weight water was then added and stirred for about 20 to 30 minutes, before removing excess free isocyanates and amines.

The polyurea thickener can also be prepared, if desired, by reacting an amine and a diamine with diisocyanate in the absence of water. For example, polyurea can be prepared by reacting the following components:

1. A diisocyanate or mixture of diisocyanates having the formula OCN—R—NCO, wherein R is a hydrocarbylene having from 2 to 30.carbons, preferably from 6 to 15 carbons, and most preferably 7 carbons.

2. A polyamine or mixture of polyamines having a total of 2 to 40 carbons and having the formula:

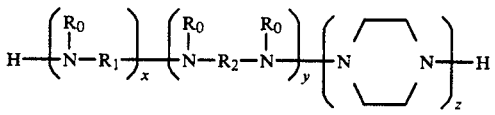

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1–C4 alkyl, and preferably hydrogen; x is an integer from 0 to 4; y is 0 or 1; and z is an integer equal to 0 when y is 1, and equal to 1 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The molar ratio of the reactants present can vary from 0.1–2 molar parts of monoamine or monoisocyanate and 0–2 molar parts of polyamine for each molar part of diisocyanate. When the monoamine is employed, the molar quantities can be (m+1) molar parts of diisocyanate, (m) molar parts of polyamine and 2 molar parts of monoamine. When the monoisocyanate is employed, the molar quantities can be (m) molar parts of diisocyanate, (m+1) molar parts of polyamine and 2 molar parts of monoisocyanate (m is a number from 0.1 to 10, preferably 0.2 to 3, and most preferably 1).

Mono- or polyurea compounds can have structures defined by the following general formula:

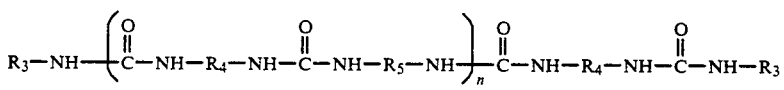

(1)

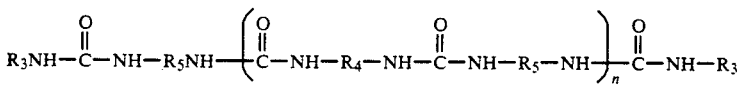

(2)

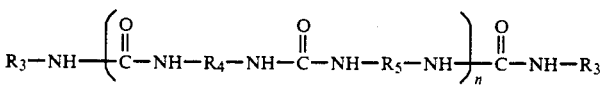

(3)

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturated (one or more double-bonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula. 1 above are prepared by reacting (n+1) molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with (n+1) molar parts of a diamine and 2 molar parts of a monoisocyanate. (When n equals zero in the above Formula 2, the diisocyanate is deleted). Mono- or polyureas having the structure presented in Formula 3 above are prepared by reacting (n) molar parts of a diisocyanate with (n) molar parts of a diamine and 1 molar part of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst and is initiated by merely contacting the component reactants under conditions conducive for the reaction. Typical reaction temperatures range from 70° F. to 210° F. at atmospheric pressure. The reaction itself is exothermic and, by initiating the reaction at room temperature, elevated temperatures are obtained. External heating or cooling may be used.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadecadienylamine, abietylamine, aniline, toluidine, naphthylamine, cumylamine, bornylamine, fenchylamine, tertiary butyl aniline, benzylamine, betaphenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc. Unsaturated amines are particularly useful. Illustrative of monoisocyanates are: hexylisocyanate, decylisocyanate, dodecylisocyante, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

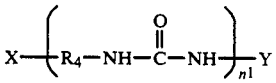

(4)

wherein $n^1$ is an integer of 1 to 3, $R_4$ is defined supra; X and Y are monovalent radicals selected from Table 1 below:

TABLE I

| X | Y |
|---|---|
| $R_7-\overset{O}{\overset{\|}{C}}-NH-$ | $R_7-\overset{O}{\overset{\|}{C}}-NH-R_5-$ |
| 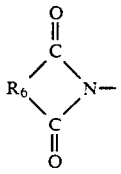 | 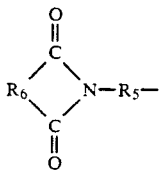 |
| | $R_8-$ |

In Table 1, $R_5$ is defined supra, $R_8$ is the same as $R_3$ and defined supra, $R_6$ is selected from the groups consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2) above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

Biurea (diurea) may be used as a thickener, but it is not as stable as polyurea and may shear and lose consistency when pumped. If desired, triurea can also be included with or used in lieu of polyurea or biurea.

Additives

In order to attain extreme pressure properties, antiwear qualities, elastomeric compatibility, high temperature stability, high temperature non-corrosivity, and a safe, non-toxic product, the additives in the additive package comprise calcium sulfate and calcium acetate as the preferred sulfate and aliphatic monocarboxylate. Advantageously, the use of both calcium acetate and especially calcium sulfate in the additive package adsorbs oil in a manner similar to polyurea and, therefore, less polyurea thickener is required to achieve the desired grease consistency. Typically, the cost of calcium sulfate and calcium acetate are much less than polyurea and, therefore, the grease can be formulated at lower costs.

Preferably, the calcium sulfate and the calcium acetate are each present in the additive package in an amount ranging from 0.1% to 20% by weight of the grease. For ease of handling and manufacture, the calcium sulfate is most preferably present in the additive package in an amount ranging from 3% to 7% by weight of the grease. For best results, the calcium acetate is most preferably present in an amount ranging from 6% to 15% by weight of the grease.

Desirably, the maximum particle sizes of the calcium sulfate and the calcium acetate are 100 microns and the calcium sulfate and the calcium acetate are of food-grade quality to minimize abrasive contaminants and promote homogenization. Calcium acetate can be provided in dry solid form as $CH_3CO_2Ca$. Calcium sulfate can be provided in dry solid form as $CaSo_4$ or any of the several available solid hydrate forms.

If desired, the calcium sulfate and/or calcium acetate can be added, formed, or created in situ in the grease as reaction of appropriate chemical reagents. For example, calcium acetate can be produced by reacting calcium hydroxide or calcium oxide with acetic acid in the grease. Calcium sulfate can be produced by reacting sulfuric acid with calcium oxide or calcium hydroxide in the grease. Other methods for forming calcium acetate and/or calcium sulfate can also be used.

When forming the calcium sulfate and/or calcium acetate from reaction of calcium hydroxide with other appropriate and generally acidic reagents, it is generally preferred to use excess calcium hydroxide relative to the stoichiometric amount required. There are several reasons for this. First, excess or unreacted acids should be avoided in the final grease. Such free, unreacted acid will seriously decrease, if not entirely eliminate, the desired elastomer compatibility of the final grease. Use of excess calcium hydroxide will insure that no unreacted acidic material remains in the final grease. Another reason for using excess calcium hydroxide is that such excess unreacted calcium hydroxide further improves the wear resistance properties of the final grease. When forming the calcium sulfate and/or calcium acetate in situ by reaction of calcium hydroxide and appropriate reagents, an excess of at least 2% calcium hydroxide over the stoichiometric required amount should be used. Preferably, at least 10% excess calcium hydroxide should be used. Most preferably for best results, at least 20% excess calcium hydroxide should be used when forming the calcium sulfate and/or calcium acetate in situ.

The preferred sulfate additive is anhydrous calcium sulfate for best results. While calcium sulfate is preferred, other sulfate additives can be used, if desired, in conjunction with or in lieu of calcium sulfate. Such other sulfates include the sulfates of Group 2a alkaline earth metal, such as beryllium, magnesium, calcium, strontium, or barium, or the sulfates of a Group 1a alkali metal, such as lithium, sodium, or potassium.

Desirably, calcium sulfate is less expensive, less toxic, more readily available, safer, and more stable than other sulfates. Calcium sulfate is also superior to calcium bisulfate. Calcium sulfate has unexpectedly been found to be compatible and non-corrosive with elastomers and seals of front-wheel drive joints. Calcium sulfate is also essentially water-insoluble and will not wash out of the grease when contamination by water occurs. Calcium bisulfate, however, was found to corrode, crack, and/or degrade some elastomers and seals of front-wheel drive joints. Calcium bisulfate was also undesirably found to be water-soluble and wash out of the grease when the front-wheel drive joint was contacted with water, which significantly decreased the antiwear and extreme pressure qualities of the grease.

The preferred aliphatic monocarboxylic additive is calcium acetate for best results. While calcium acetate is preferred, other aliphatic monocarboxylic additives can be used, if desired, in conjunction with or in lieu of calcium acetate. Such other aliphatic monocarboxylic additives include the aliphatic moncarboxylates of Group 2a alkaline earth metal, such as beryllium, magnesium, calcium, strontium, or barium, or aliphatic monocarboxylates of Group 1a alkali metal, such as lithium, sodium, or potassium. The aliphatic monocarboxylate should have 1 to 5 carbon atoms per molecule. Preferably, the aliphatic monocarboxylate should have 1 to 3 carbon atoms per molecule. Most preferably for best results, the aliphatic monocarboxylate should have 2 carbon atoms per molecule, i.e., acetate.

Desirably, calcium acetate is less expensive, more readily available either as calcium acetate or as chemicals which can be reacted to form calcium acetate, and safer than other aliphatic monocarboxylates. Also, monocarboxylates derived from butanoic and pentanoic acids have an undesirable odor which limit their general usefulness.

In another preferred form, the additive package further comprises calcium carbonate as a partial but not complete substitute for the calcium sulfate. This substitution of calcium carbonate for part, but not all, of the calcium sulfate is most conveniently measured on a weight basis. When calcium carbonate is substituted for calcium sulfate, preferably 20% to 80% of the calcium sulfate should be replaced with an equal weight of calcium carbonate. Most preferably for best results, 40% to 60% of the calcium sulfate should be replaced with an equal weight of calcium carbonate.

The use of both calcium sulfate and calcium acetate together in the additive package of the extreme pressure and wear resistant grease was found to produce unexpected superior results in comparison to a similar grease with an equal amount by weight of: (a) calcium sulfate alone in the absence of calcium acetate, or (b) calcium acetate alone in the absence of calcium sulfate. This fact proves the surprising beneficial synergism of calcium sulfate and calcium acetate.

Furthermore, when part of the calcium sulfate was replaced by an equal weight of calcium carbonate, the resulting grease was found to produce superior results compared to a grease in which all the calcium sulfate was replaced by an equal weight of calcium carbonate. This fact proves the superiority of calcium sulfate, calcium carbonate, and calcium acetate as an extreme pressure and wear resistant additive system when compared to calcium carbonate and calcium acetate without calcium sulfate.

EXAMPLE 2

This test served as the control for subsequent tests. A base grease was formulated with about 15% by weight polyurea thickener and about 85% by weight paraffinic solvent base oil. This control grease was prepared by using a 22% polyurea base grease prepared in a manner similar to that described in Example 1. A portion of the 22% polyurea-thickened base grease was mixed with additional paraffinic solvent-extracted base oil and given three passes through a three roll mill. No additive package was added to this control grease; neither calcium sulfate, calcium acetate, nor calcium carbonate were present. The EP (extreme pressure)/antiwear properties of the base grease, comprising the last nonseizure load, weld load, and load wear index were measured using the Four Ball EP method as described in ASTM D2596. The results were as follows:

| | |
|---|---|
| Last nonseizure load, kg | 32 |
| Weld load, kg | 100 |
| Load wear index | 16.8 |

EXAMPLE 3

To a 40-pound capacity laboratory kettle was added 8 pounds of the 22% polyurea-thickened base grease described and used in Example 2. The base grease was heated and stirred at 170° F. and 4.54 pounds of a base oil was slowly added. The base oil had a viscosity of about 850 SUS at 100° F. and was a paraffinic, solvent-extracted, dewaxed, hydrogenated mineral oil. Then 7.18 pounds of another base oil was slowly added. This base oil had a viscosity of about 350 SUS at 100° F. and was a paraffinic, solvent-extracted, dewaxed, hydrogenated mineral oil. Once the grease was well mixed, 1169.4 grams of calcium hydroxide was added and the resulting mixture stirred at 170° F. until the texture was relatively smooth. Then 1517.33 grams of glacial acetic acid was added and the resulting mixture was stirred at 180° F. for 30 minutes. The grease was then stirred and heated to 300° F. using stream in the kettle jacket for the source of heat. When the grease reached 300° F. the kettle was closed and a vacuum was applied for ten minutes while continuing to heat and stir the grease. Then the vacuum was released, the kettle was opened, and the grease was cooled to 170° F. Then the grease was removed and given one pass through a Gaulin homogenizer at 7,000 psi milling pressure. Thus milled, the grease was stored for further use. The grease had the following composition.

| Component | % (wt) |
|---|---|
| 850 SUS Oil | 43.76 |
| 350 SUS Oil | 29.15 |
| Polyurea | 7.14 |
| Calcium Acetate | 17.86 |
| Excess Calcium Hydroxide | 2.09 |

This grease served as a source of polyurea grease with calcium acetate already present. As can be seen, 25% more calcium hydroxide was used than the stoichiometric amount required to react with all the acetic acid.

EXAMPLES 4-6

Three extreme pressure and wear resistant greases were prepared by mixing various amounts of the base grease described and used in Example 2, the grease of Example 3, anhydrous calcium sulfate, 850 SUS oil, and 350 SUS oil. The base oils were the same as those described in Example 3. The calcium sulfate had an average mean diameter of less than 3.75 to 4.40 microns. The resultant three mixtures were mixed and milled in a three roll mill until a homogeneous grease was produced. The Four Ball EP Test was performed on each grease. Composition and test data for the three greases are given below.

| Example No. | 4 | 5 | 6 |
|---|---|---|---|
| Example 2 Base Grease, grams | — | 11.73 | 50.00 |
| Example 3 Grease, grams | 150.00 | 84.00 | — |
| Calcium Sulfate, grams | — | 7.50 | 27.50 |
| 850 SUS Oil, grams | 17.15 | 24.39 | 47.90 |
| 350 SUS Oil, grams | 11.43 | 22.38 | 57.93 |
| Component, % (wt) | | | |
| 850 SUS Oil | 46.34 | 46.70 | 47.40 |
| 350 SUS Oil | 30.90 | 31.13 | 31.60 |
| Polyurea | 6.00 | 6.00 | 6.00 |
| Calcium Acetate | 15.00 | 10.00 | — |
| Calcium Sulfate | — | 5.00 | 15.00 |
| Excess Calcium Hydroxide | 1.76 | 1.17 | — |
| Test Data | | | |
| Four Ball EP, ASTM D2596, | | | |
| Last Non-Seizure Load. Kg | 80 | 80 | 63 |
| Weld Load, Kg | 315 | 620 | 400 |
| Load Wear Index | 56.1 | 93.1 | 53.7 |

As can be seen, the total level of calcium sulfate and calcium acetate was held constant at 15% for all three greases. Also, the percent polyurea thickener was held constant at 6% for all three greases. Even the ratio of 850 SUS oil/350 SUS Oil was held constant at 60/40 for all three greases. However, the grease of Example 5 which had both calcium sulfate and calcium acetate gave far superior results than the grease of Example 4 with calcium acetate alone or the grease of Example 6 with calcium sulfate alone. This result establishes the surprising and unexpected synergism of calcium acetate and calcium sulfate as extreme pressure and wear resistant additives.

EXAMPLES 7-9

A series of three more greases were made to illustrate the effect of partial substitution of the calcium sulfate with calcium carbonate in greases similar to that of Example 6 above. Greases were prepared in a manner similar to the grease of Example 6. The calcium carbonate used had a mean particle diameter less than 2 microns. Compositions and test data are given below.

| Example No | 7 | 8 | 9 |
|---|---|---|---|
| Example 3 Grease, grams | 150.00 | 150.00 | 150.00 |
| Calcium Sulfate, grams | 9.57 | — | 4.78 |
| Calcium Carbonate, grams | — | 9.57 | 4.78 |
| 850 SUS Oil, grams | 16.76 | 16.76 | 16.76 |
| 350 SUS Oil, grams | 11.18 | 11.18 | 11.18 |
| Component, % (wt) | | | |

-continued

| Example No | 7 | 8 | 9 |
|---|---|---|---|
| 850 SUS Oil | 43.94 | 43.94 | 43.94 |
| 350 SUS Oil | 29.29 | 29.29 | 29.29 |
| Polyurea | 5.71 | 5.71 | 5.71 |
| Calcium Acetate | 14.29 | 14.29 | 14.29 |
| Calcium Sulfate | 5.10 | — | 2.55 |
| Calcium Carbonate | — | 5.10 | 2.55 |
| Excess Calcium Hydroxide | 1.67 | 1.67 | 1.67 |
| Test Data | | | |
| Four Ball EP, ASTM D2596, | | | |
| Last Non-Seizure Load, Kg | 80 | 100 | 100 |
| Weld Load, Kg | 800 | 500 | 620 |
| Load Wear Index | 111.2 | 85.6 | 101.2 |

Comparison of test data for Examples 7 and 8 once again demonstrate the superior performance of the sulfate/acetate combination over the carbonate/acetate combination. Comparing test data for Examples 8 and 9 show that when half of the calcium carbonate of Example 8 is replaced by calcium sulfate, performance increases. This demonstrates that the combination of sulfate, carbonate, and acetate is superior to the combination of carbonate and acetate. This is true even when the total amount of sulfate and carbonate in the sulfate, carbonate, and acetate grease is equal to the level of carbonate in the carbonate acetate grease.

EXAMPLES 10-12

Three more greases were made using a grease similar to that prepared in Example 3. Calcium sulfate similar to that used in Examples 4-9 was added. Also used were ferrous corrosion inhibitors sold under the brand names of Nasul BSN-HT and Nasul 729 by King Industries. Nasul 729 contains calcium dinonylnaphthylene sulfonate and Nasul BSN-NT contains barium dinonylnaphthylene sulfonate. Also used was an alkylated diphenylamine-type antioxidant sold under the brand name of Vanlube 848 by R. T. Vanderbilt Co. These greases were milled through a Gaulin homogenizer at a 7,000 psi milling pressure to obtain a homogeneous structure. All three resulting greases were very smooth and had an almost silk-like feel. Final compositions and test data are given below.

| Example No. | 10 | 11 | 12 |
|---|---|---|---|
| Component, % (wt) | | | |
| 850 SUS Oil | 43.72 | 42.88 | 44.08 |
| 350 SUS Oil | 29.14 | 28.58 | 29.38 |
| Polyurea | 5.77 | 5.43 | 5.43 |
| Calcium Acetate | 14.43 | 13.58 | 13.58 |
| Calcium Sulfate | 5.05 | 4.75 | 4.75 |
| Excess Calcium Hydroxide | 1.69 | 1.59 | 1.59 |
| Nasul BSN-HT | — | 1.50 | — |
| Nasul 729 | — | — | 1.00 |
| Vanlube 848 | 0.20 | 1.69 | 0.19 |
| Test Data | | | |
| Worked Penetration, ASTM D217 | 284 | 306 | 319 |
| Dropping Point, ASTM D2265 | 472 | 500 | 497 |
| Oil Separations, SDM 433, % | | | |
| 24 hr, 212° F. | 1.4 | 1.3 | 2.6 |
| 24 hr, 300° F. | 3.3 | 0.8 | 2.0 |
| 24 hr, 350° F. | 13.6 | 6.3 | 6.7 |
| Four Ball Wear, ASTM D2266 at 40 kg, 1200 rpm for 1 hr | 0.36 | 0.41 | 0.40 |
| Four Ball EP, ASTM D2596 | | | |
| Last Nonseizure Load, kg | 100 | 80 | 80 |
| Weld Load, kg | 800 | 800 | 500 |
| Load Wear Index | 123.3 | 114.2 | 82.7 |
| Optimol SRV Stepload Test, 80° C. Maximum Passing Load, Newtons | 900 | 800 | 900 |

-continued

| Example No. | 10 | 11 | 12 |
|---|---|---|---|
| Oxidation Stability, ASTM D942, 210° F. | | | |
| Pressure Loss after 100 hrs., psi | — | 2 | — |
| Pressure Loss after 500 hrs., psi | — | 9 | — |
| Copper Strip Corrosion, ASTM D4048 300° F., 24 hr | 1A | 1A | 1A |
| Steel Strip Corrosion, 300° F., 24 hr. | No Discoloration | | |
| Elastomer Compatibility with Polyester | | | |
| % loss tensile strength | — | 10.4 | 16.4 |
| % loss maximum elongation | — | 6.60 | 9.36 |
| Elastomer Compatibility with Silicone | | | |
| % loss tensile strength | — | — | 4.81 |
| % loss maximum elongation | — | — | 15.3 |

The Optimol SRV Stepload test is the procedure specified by the U.S. Air Force Laboratories Test Procedure of Mar. 6, 1985. In the test, a 10 mm steel ball is oscillated under load increments of 100 newtons on a lapped steel disc lubricated with the grease being tested until seizure occurs. The oil separation test (cone bleed test), SDM 433, is a standard test of the Saginaw Steering Gear Division of General Motors. In the test, the grease was placed on a 60 mesh nickel screen cone. The cone was heated in an oven for the indicated time at the listed temperature. The percentage decrease in the weight of the grease was measured. The steel strip corrosion test is identical to the ASTM D4048 Copper Strip Test except that a polished steel strip is used instead of a polished copper strip.

As can be seen the test results are excellent. Dropping points are high. Extremely high levels of extreme pressure and wear resistance are obtained as indicated by very high Four Ball EP results and the unusually small Four Ball Wear scars. Optimol SRV test results are also good. Oil separation results are good. Comparison of the three greases show that the sulfonate additives in Examples 11 and 12 lower the oil separation values at 350° F. This is all the more remarkable since the greases of Examples 11 and 12 are considerably softer than the grease of Example 10. Oxidation stability and elastomer compatibility results are also good.

Among the many advantages of the novel lubricating grease are:

1. High performance in heavily loaded applications.
2. Outstanding extreme pressure properties.
3. Outstanding wear resistance properties.
4. Superior fretting wear protection.
5. Excellent oil separation qualities, even at high temperatures.
6. Remarkable compatibility and protection of elastomers and seals of such as used in front-wheel drive joints and other automotive, industrial, and military applications.
7. Greater stability at high temperatures for long periods of time.
8. Superior oil separation properties over a wide temperature range.
9. Excellent performance over a wide temperature range.
10. Simpler to manufacture.
11. Easier to pump.
12. Safe.
13. Economical.
14. Effective.

Although embodiments of this invention have been described, it is to be understood that various modifications and substitutions can be made by those skilled in the art without departing from the novel spirit and scope of this invention.

That which is claimed is:

1. A lubricating grease, comprising:
a base oil;
a polyurea thickener; and
a sufficient amount of an additive package to impart extreme pressure properties to said lubricating grease, said additive package comprising
a sulfate of a Group 1a alkali metal or a Group 2a alkaline earth metal; and
an aliphatic monocarboxylate of a Group 1a alkali metal or of a group 2a alkaline earth metal; wherein said aliphatic monocarboxylate has from 1 to 5 carbon atoms per molecule.

2. A lubricating grease in accordance with claim 1 wherein said Group 1a alkali metal is selected from the group consisting of lithium, sodium, and potassium.

3. A lubricating grease in accordance with claim 1 wherein said Group 2a alkaline earth metal is selected from the group consisting of beryllium, magnesium, calcium, strontium, and barium.

4. A lubricating grease in accordance with claim 1 wherein said aliphatic monocarboxylate has no more than 3 carbon atoms per molecule.

5. A lubricating grease in accordance with claim 1 wherein said aliphatic monocarboxylate comprises calcium acetate.

6. A lubricating grease in accordance with claim 1 wherein said aliphatic monocarboxylate comprises an aliphatic monocarboxylate of a Group 2a alkaline earth metal selected from the group consisting of beryllium, magnesium, calcium, strontium, and barium or a Group 1a alkali metal selected from the group consisting of lithium, sodium, and potassium.

7. A lubricating grease in accordance with claim 1 wherein said sulfate comprises calcium sulfate.

8. A lubricating grease in accordance with claim 1 wherein said additive package includes a carbonate.

9. A lubricating grease, comprising:
a base oil;
a thickener comprising a member selected from the group consisting of biurea, triurea, and polyurea; and
an extreme pressure additive package comprising calcium sulfate and calcium acetate.

10. A lubricating grease in accordance with claim 9 wherein said calcium acetate comprises anhydrous calcium acetate.

11. A lubricating grease in accordance with claim 9 wherein said additive package includes calcium carbonate.

12. A lubricating grease in accordance with claim 9 wherein said calcium acetate and said calcium sulfate are each present in an amount ranging from about 0.1% to about 20% by weight of said grease.

13. A lubricating grease in accordance with claim 9 wherein the maximum particle sizes of said calcium acetate and said calcium sulfate are about 100 microns.

14. A lubricating grease, comprising:
from about 45% to about 85% by weight base oil;
from about 1% to about 15% by weight thickener comprising polyurea;
from about 0.2% to about 40% by weight of an extreme pressure wear-resistant additives, said additives comprising calcium sulfate and calcium acetate, said calcium sulfate being present in an amount ranging from about 0.1% to about 20% by weight of said grease and said calcium acetate being present in an amount ranging from about 0.1% to about 20% by weight of said grease.

15. A lubricating grease in accordance with claim 14 wherein said base oil comprises a member selected from the group consisting of naphthenic oil, paraffinic oil, aromatic oil, and a synthetic oil, said synthetic oil comprising a member selected from the group consisting of a polyalphaolefin, a polyol ester, and a diester.

16. A lubricating grease in accordance with claim 14 wherein said base oil comprises about 60% by weight of an 850 SUS refined, solvent-extracted, hydrogenated, dewaxed base oil and about 40% by weight of a 350 SUS refined, solvent-extracted, hydrogenated, dewaxed base oil.

17. A lubricating grease in accordance with claim 14 wherein said additives comprise calcium carbonate, and said calcium carbonate being present in an amount about equal to said calcium sulfate.

18. A lubricating grease in accordance with claim 14 wherein said grease comprises:

at least 60% by weight of said base oil;

from about 3% to about 10% by weight of said polyurea thickener; and from about 9% to about 22% by weight of said extreme pressure wear-resistant additives.

19. A lubricating grease in accordance with claim 18 wherein:

said calcium sulfate is present in an amount ranging from about 3% to about 7% by weight of said grease; and said calcium acetate is present in an amount ranging from about 6% to about 15% by weight of said grease.

20. A lubricating grease in accordance with claim 18 wherein said additives include calcium hydroxide.

* * * * *